US006728510B1

(12) United States Patent
Markovitz et al.

(10) Patent No.: US 6,728,510 B1
(45) Date of Patent: Apr. 27, 2004

(54) SHEET COPY DOCUMENTS PRODUCTION MACHINE HAVING AN UNLOAD-WHILE-RUN SAFETY SHIELD

(75) Inventors: James Markovitz, Penfield, NY (US); Richard J. Milillo, Fairport, NY (US); Brian J. Dunham, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/440,751

(22) Filed: May 19, 2003

(51) Int. Cl.[7] ..... G03G 15/00

(52) U.S. Cl. ..... 399/403; 399/124; 399/405; 399/407

(58) Field of Search ..... 399/21, 107, 124, 399/403, 404, 405, 407, 408, 410

(56) References Cited

U.S. PATENT DOCUMENTS 5,995,773 A * 11/1999 Awano ..... 399/21

RE37,157 E * 5/2001 Ikeda et al. ..... 399/124

* cited by examiner

*Primary Examiner*—Hoang Ngo
(74) *Attorney, Agent, or Firm*—Tallam I. Nguti

(57) ABSTRACT

A sheet-copy documents producing machine is provided and includes (a) sheet supply and feeding means for supplying and feeding image receiving sheets along a path and through image forming stations; (b) image forming devices mounted at the image forming stations for forming desired images on the image receiving sheets resulting in sheet-copy documents of the desired images; and (c) plural sheet-copy documents finishing devices including (i) moving parts, and (ii) at least a first sheet-copy documents finishing device and a last sheet-copy documents finishing device for each receiving, finishing and stacking the sheet-copy documents into stacks for subsequent removal by an operator. Each the sheet-copy documents finishing devices, except the last sheet-copy documents finishing device, including a movable unload-while-running safety shield assembly for protecting hands of the operator from the moving parts during an unload-while-running operation of the copy sheet documents producing machine.

20 Claims, 5 Drawing Sheets

SHEET COPY DOCUMENTS PRODUCTION MACHINE HAVING AN UNLOAD-WHILE-RUN SAFETY SHIELD

BACKGROUND OF THE INVENTION

The present invention relates generally to sheet-copy documents production machines such as toner image production machines, and more particularly, concerns such a sheet-copy documents producing machine including a finisher having an unload-while-run safety shield.

In a typical toner image production machine such as an electrostatographic reproduction machine, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This process records an electrostatic latent image on the photoconductive member corresponding to the informational areas contained within the original document. After the electrostatic latent image is recorded on the photoconductive member, the latent image is developed by bringing a developer material into contact therewith.

Generally, the developer material is made from toner particles adhering triboelectrically to carrier granules. The toner particles are attracted from the carrier granules to the latent image forming a toner powder image on the photoconductive or image bearing member. The toner powder image is then transferred at an image transfer station, from the photoconductive member, to a copy substrate such as a copy sheet of paper.

Thereafter, heat or some other treatment is applied to the toner particles at a fusing station to permanently fuse and affix the toner powder image to the copy sheet or substrate. The copy sheet or substrate typically is fed automatically from a stack supply thereof, along a sheet transport path that includes a sheet registration subassembly, to the image transfer station where the toner image is transferred from the image bearing member onto a first side of the copy sheet. As discussed above, after such toner image transfer, the copy sheet is moved along the sheet path to the fusing station of the machine where the toner image is fused and affixed to the copy sheet forming a sheet-copy.

In machines with duplex copying capability, the sheet path usually includes a sheet inverter, and the copy sheet after leaving the fusing station, is inverted at the inverter and refed to the transfer station in proper orientation for receiving a second toner image on a second side of the copy sheet. In either case, the copy sheet with the fused toner image or images on it is then forwarded to an output tray or finisher. In high speed, high volume such machines, multiple high capacity sheet feeders and multiple finishing apparatus or finishers are typically used, and the machine is enabled for unload-while-running operation.

There is however a problem when the operator must unload sheet sets from a finisher while the machine is still running, unload-while-running. The operator must be protected from moving parts in such a case. This is because the operator can be injured directly by moving parts, and if an undetected fire for example occurs in the upper portion of the finisher while the operator is unloading sheet sets, the operator can be injured by melted plastic or other melted material that could fall on their hand or arms. Any protective device however must also be moved out of the way during normal operation of the finisher.

SUMMARY OF THE INVENTION

In accordance with the present invention, there is provided in a sheet-copy documents producing machine is provided and includes (a) sheet supply and feeding means for supplying and feeding image receiving sheets along a path and through image forming stations; (b) image forming devices mounted at the image forming stations for forming desired images on the image receiving sheets resulting in sheet-copy documents of the desired images; and (c) plural sheet-copy documents finishing devices including (i) moving parts, and (ii) at least a first sheet-copy documents finishing device and a last sheet-copy documents finishing device for each receiving, finishing and stacking the sheet-copy documents into stacks for subsequent removal by an operator. Each the sheet-copy documents finishing devices, except the last sheet-copy documents finishing device, including a movable unload-while-running safety shield assembly for protecting hands of the operator from the moving parts during an unload-while-running operation of the copy sheet documents producing machine.

BRIEF DESCRIPTION OF THE DRAWINGS

Other features of the present invention will become apparent as the following description proceeds and upon reference to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
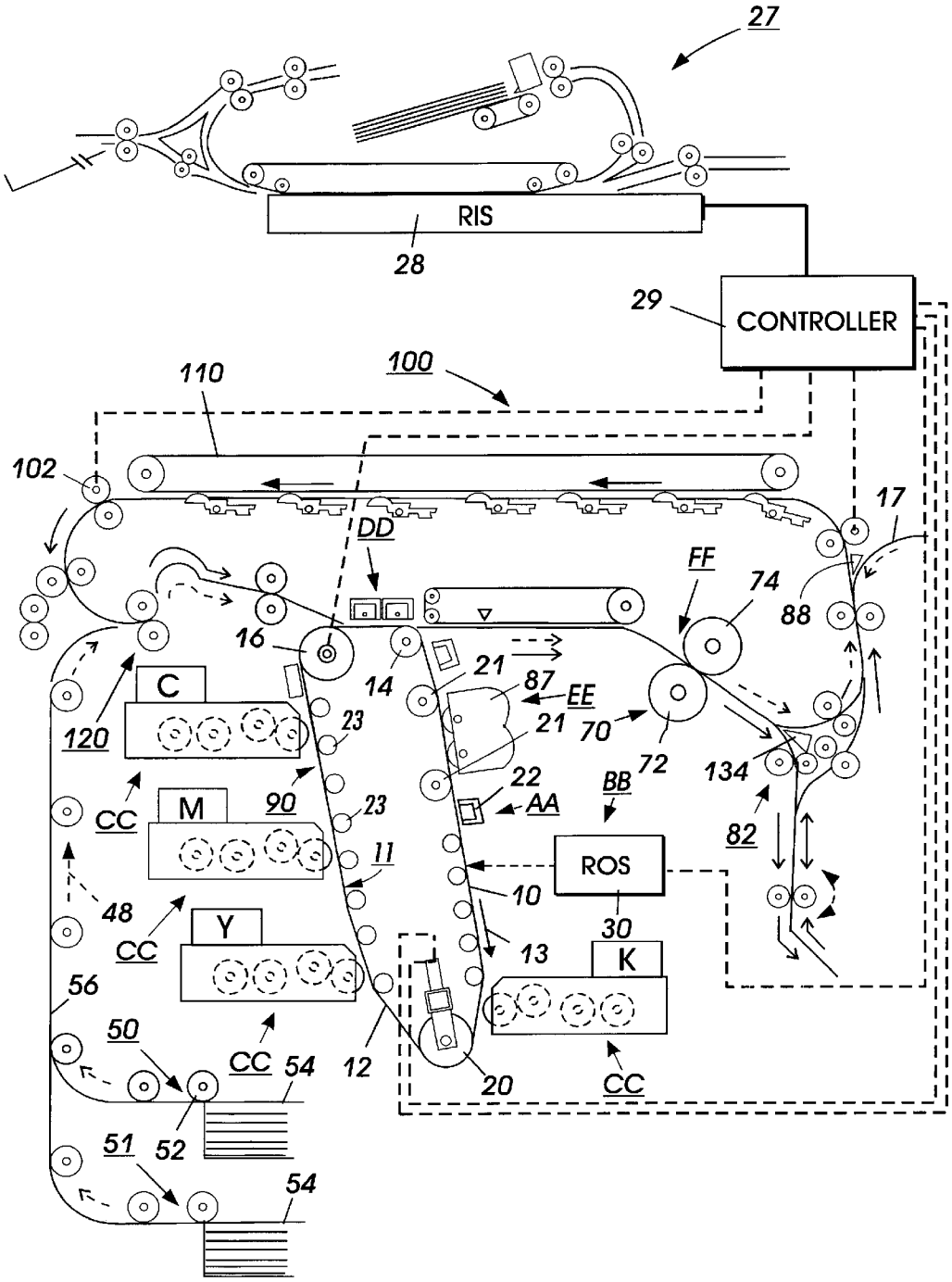
FIG. 1 is a schematic elevational view of a toner image producing machine such as an electrostatographic reproduction machine.

Referring now FIG. 1, it schematically illustrates a sheet-documents producing machine such as an electrostatographic reproduction machine 8 which generally employs a photoconductive belt 10 mounted on a belt support module 90. Preferably, the photoconductive belt 10 is made from a photoconductive material coated on a ground layer which, in turn, is coated on an anti-curl backing layer. Belt 10 moves in the direction of arrow 13 to advance successive portions sequentially through the various processing stations disposed about the path of movement thereof. Belt 10 is entrained as a closed loop 11 about stripping roll 14, drive roll 16, and idler roll 21.

Initially, a portion of the photoconductive belt surface passes through charging station AA. At charging station AA, a corona generating device indicated generally by the reference numeral 22 charges the photoconductive belt 10 to a relatively high, substantially uniform potential. As also shown FIGS. 1–4, the machine 8 includes a controller or electronic control subsystem (ESS), indicated generally be reference numeral 29 which is preferably a self-contained, dedicated mini-computer having a central processor unit (CPU), electronic storage, and a display or user interface (UI). The ESS 29, with the help of sensors and connections, can read, capture, prepare and process image data and machine status information. As such, it is the main control system for components and other subsystems of the machine 8 including the closed loop belt tensioning mechanism 200 of the present invention.

Referring again to FIG. 1, at an exposure station BB, the controller or electronic subsystem (ESS), 29, receives the image signals from RIS 28 representing the desired output image and processes these signals to convert them to a continuous tone or gray scale rendition of the image which is transmitted to a modulated output generator, for example the raster output scanner (ROS), indicated generally by reference numeral 30. The image signals transmitted to ESS 29 may originate from RIS 28 as described above or from a computer, thereby enabling the machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

The controller 29 is preferably a programmable microprocessor which can be programmed to provide various controls including for example a comparison count of the copy sheets, the number of documents being recirculated, the number of copy sheets selected by the operator, time delays, jam corrections, for example. The control of all of the exemplary systems heretofore described may be accomplished by conventional control switch inputs from the machine 8 consoles selected by the operator. Conventional sheet path sensors or switches may be utilized to keep track of the position of the document and the copy sheets.

ROS 30 includes a laser with rotating polygon mirror blocks. Preferably a nine-facet polygon is used. The ROS 30 illuminates the charged portion on the surface of photoconductive belt 10 at a resolution of about 300or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station CC, which includes four developer units containing cmyk color toners, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station DD. A print sheet 48 is advanced to the transfer station DD, by a sheet feeding apparatus 50. Preferably, sheet feeding apparatus 50 includes a feed roll 52 contacting the uppermost sheet of stack 54. Feed roll 52 rotates to advance the uppermost sheet from stack 54 to vertical transport 56. Vertical transport 56 directs the advancing sheet 48 of support material into registration transport 57 past image transfer station DD to receive an image from photoreceptor belt 10 in a timed sequence so that the toner powder image formed thereon contacts the advancing sheet 48 at transfer station DD. Transfer station DD includes a corona-generating device 58, which sprays ions onto the backside of sheet 48. This attracts the toner powder image from photoconductive surface 12 to sheet 48. After transfer, sheet 48 continues to move in the direction of arrow 60 by way of belt transport 62, which advances sheet 48 to fusing station FF.

Fusing station FF includes a fuser assembly indicated generally by the reference numeral 70 which permanently affixes the transferred toner power image to the copy sheet. Preferably, fuser assembly 70 includes a heated fuser roller 72 and a pressure roller 74 with the powder image on the 5 copy sheet contacting fuser roller 72. The pressure roller is crammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess lo release agent. The release agent transfers to a donor roll (not shown) and then to the fuser roll 72.

The sheet then passes through fuser 70 where the image is permanently fixed or fused to the sheet. After passing through fuser 70, a gate either allows the sheet to move directly via output 17 to a finisher or is stacker, or deflects the sheet into the duplex path 100, specifically, first into single sheet inverter 82 here. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles adhering to photoconductive surface 12 are removed therefrom at cleaning station EE. Cleaning station EE includes a rotatably mounted fibrous brush device 87 in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

Figure 2:
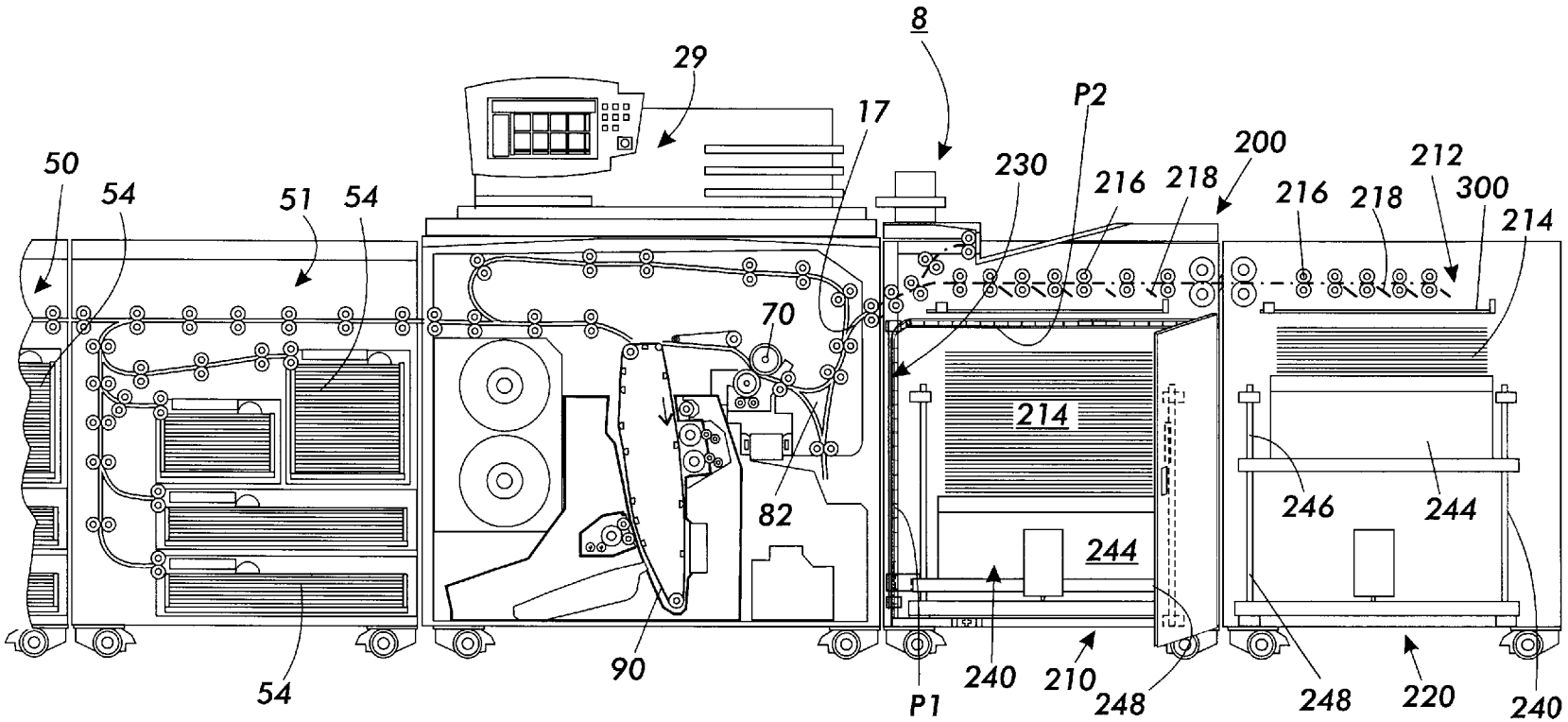
FIG. 2 is a schematic front elevational view of toner image producing machine of FIG. 1 including multiple finishers and the safety shield assembly in accordance with the present invention.
Figure 3:
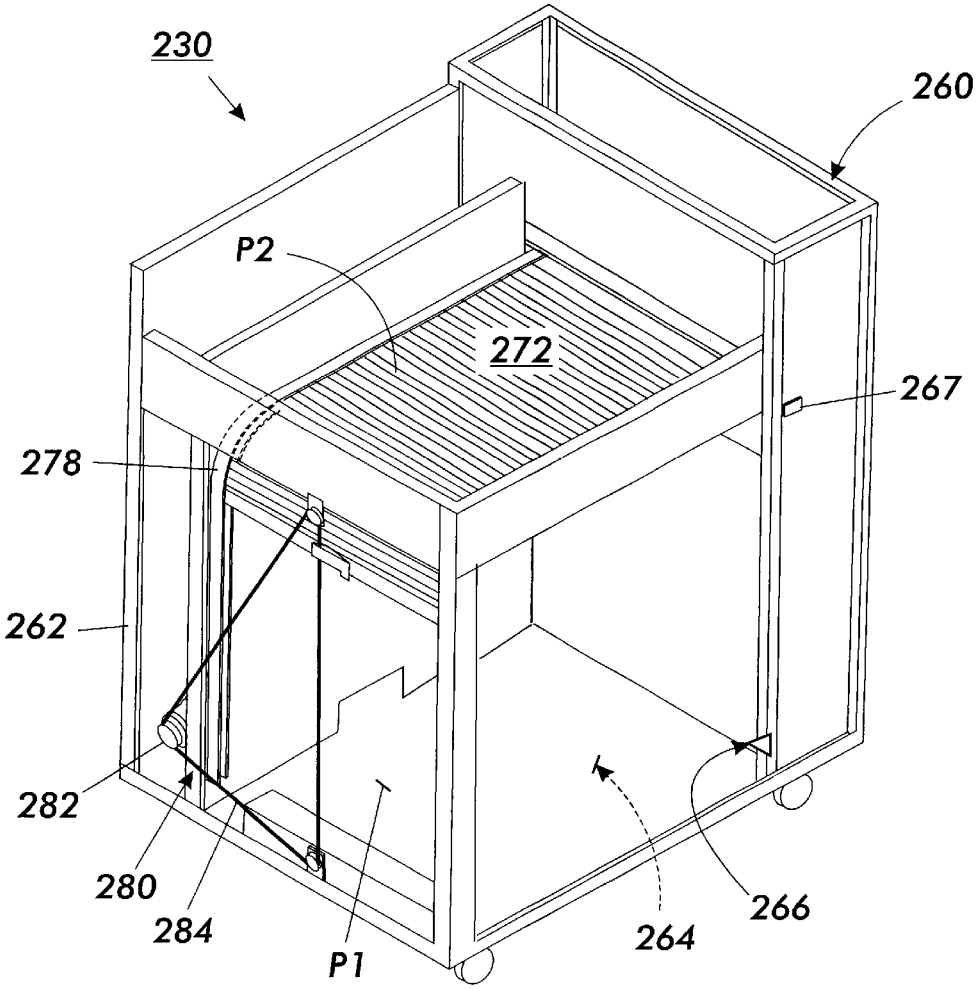
FIG. 3 is a perspective view of a frame of a finisher of FIG. 2 showing the shielding member of the safety shield assembly of the present invention in its protective position.
Figure 4:
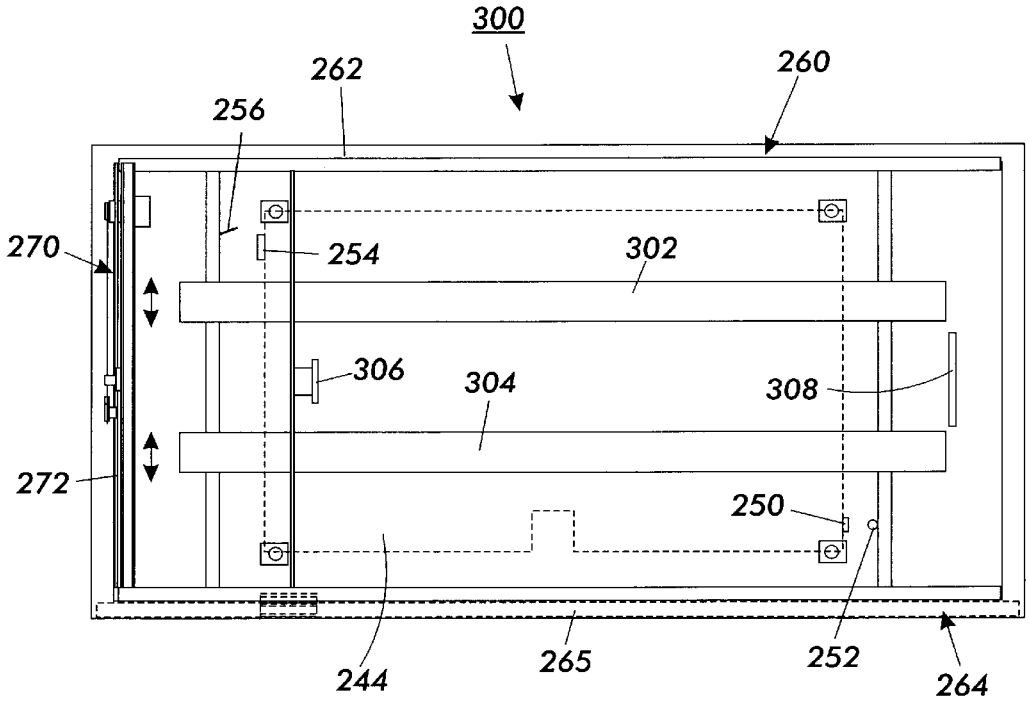
FIG. 4 is a top schematic of a compiler assembly of each of the finishers of FIG. 2.
Figure 5:
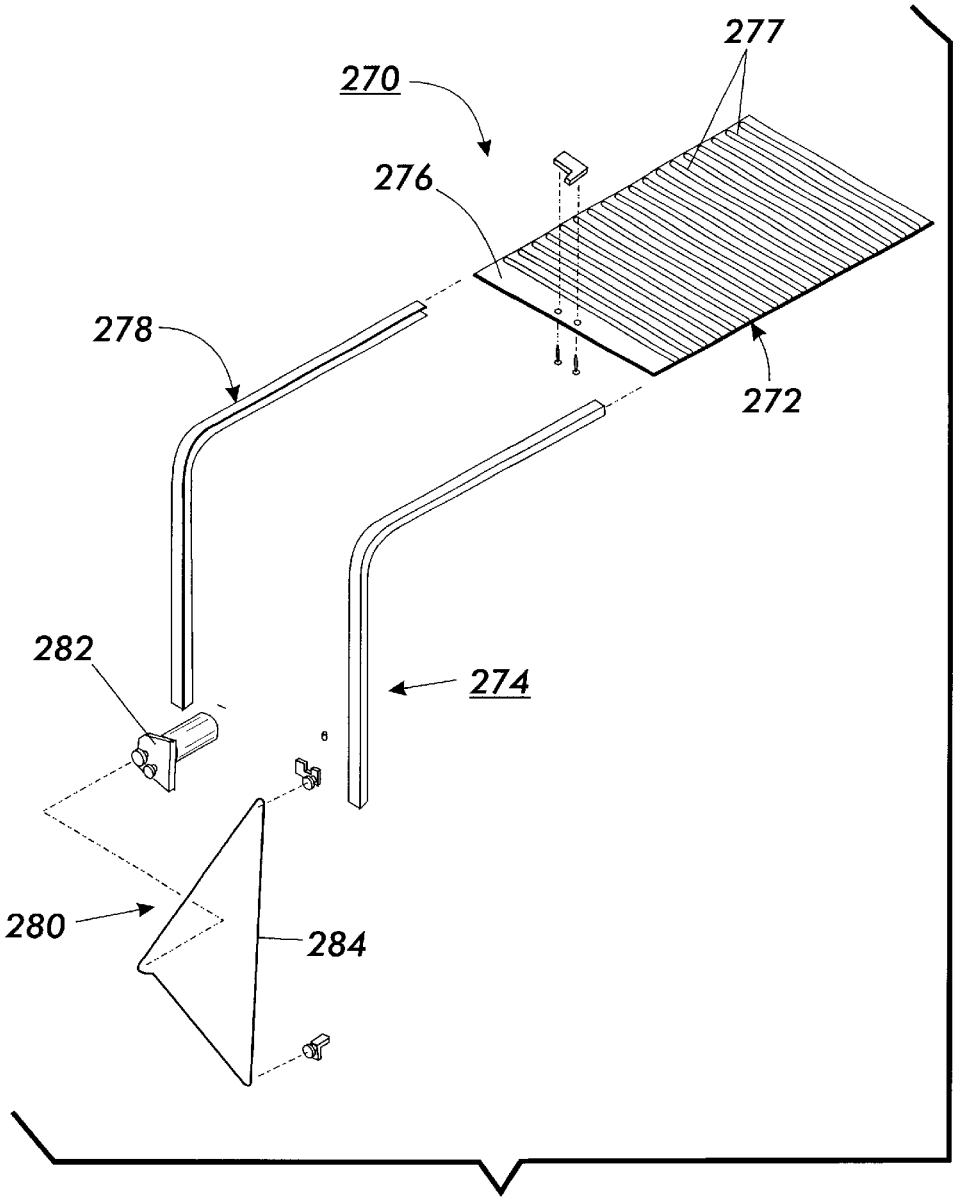
FIG. 5 is an exploded view of the safety shield assembly of the present invention.

Referring now to FIGS. 1 and 2, the sheet-documents producing machine 8 as shown includes plural sheet-copy documents finishing devices 200. Only two such devices 210 and 220 are shown, but it is understood that any plural number thereof may be used. As shown, each sheet-copy documents finishing device 210 and 220 has moving parts 212, and include at least a first sheet-copy documents finishing device 210, and a last sheet-copy documents finishing device 220, for each receiving, finishing and stacking the sheet-copy documents into stacks 214 for subsequent removal by an operator. Each of the sheet-copy documents finishing devices 21,0, except the last sheet-copy documents finishing device 220, includes a movable unload-while-running safety shield assembly 230 for protecting hands of the operator from the moving parts 212 during an unload-while-running operation of the copy sheet documents producing machine.

The moving parts 212 include sheet transport nip rollers 216 and movable sheet directing and limiting devices 218. The moving parts 212 also include a sheet compiling and release assembly 232. The moving parts 212 further include a sheet set stacker and elevator assembly 240 that has an up and down movable elevator tray 244 having an upper limit position 246 and a lower limit position 248. The upper limit position is determined by a first sensor 250 mounted on the up and down movable elevator tray 244 and a first sensor flag 252. The sheet set stacker and elevator assembly 240 also includes a sheet set stacking housing 260 having a frame 262 enclosing the movable sheet stacking elevator tray 244. The lower limit position of the tray is determined by a second sensor 254 mounted on the tray and by a second sensor flag 256 mounted on the frame 262.

The safety shield assembly 230 thus includes (a) the frame 262 defining the sheet set stacking housing 260; (b) a position detector device 254, 256 for detecting the lower limit position 248 of the movable sheet set stacking elevator tray mounted within the sheet set stacking housing; (c) a front access door subassembly 264 for allowing and inhibiting operator access into the sheet set stacking housing; and (d) a safety shield device 270 for protecting the hands of the operator from the moving parts 212 during an unload-while-running operation of the copy sheet documents producing machine.

The safety shield device 270 includes (i) a shielding member 272 having a parked position P1 and a protective position P2 relative to the sheet set stacking housing 260, and (ii) moving means 274 for moving the shielding member from one to the other of the parked position and the protective position. Relative to the housing 260, the parked position P1 of the shielding member is vertical (FIG. 2) and to one side (the left side as shown) of the access door subassembly 264, and the protective position P2 is horizontal and above the movable sheet stacking elevator tray 244.

The front access door subassembly 264 includes a shutter 265 and an automatic shutter lock 266, such as a solenoid device, that is unlockable responsively to the position detector detecting the lower limit position of the movable sheet set stacking elevator tray 244. The front access door subassembly also includes a selectively actuatable unload switch 267 for activating an unload condition of the safety shield assembly such that actuating the actuatable unload switch causes the movable sheet set stacking elevator tray to move to the lower limit position and the shielding member to move into the protective position. The front access door subassembly as such is controlled to open only after the unload switch has been activated, and the shielding member is in the protective position.

The shielding member 272 comprises a flexible one piece panel 276 that is attached, for example clamped, to embossed cross slats 277. The flexible one piece panel for example can be stainless steel. The moving means 274 include a track member 278 for entraining ends of the shielding member 272, and a drive assembly 280 consisting for example of an electric motor 282 and a timing belt 284. The shielding member 272 when in the protective or horizontal position, blocks an opening through which sheets and sets of sheets from the compiler 300 (FIG. 4) enter the stacker elevator assembly 240. As further shown, the compiler 300 includes movable sheet support members 302, 304, and sheet aligning and registration devices 306, 308, all of which are located above the elevator tray 244. The shielding member 272 when in its horizontal, protective position P2, will be located is above the tray 244 and below the compiler 300.

Advantageously, the safety shield device 270 including the shielding member 272, is relatively low cost, simple in design (one component), and uses very little space while meeting all functionality and safety considerations.

As can be seen, there has been provided a sheet-copy documents producing machine is provided and includes (a) sheet supply and feeding means for supplying and feeding image receiving sheets along a path and through image forming stations; (b) image forming devices mounted at the image forming stations for forming desired images on the image receiving sheets resulting in sheet-copy documents of the desired images; and (c) plural sheet-copy documents finishing devices including (i) moving parts, and (ii) at least a first sheet-copy documents finishing device and a last sheet-copy documents finishing device for each receiving, finishing and stacking the sheet-copy documents into stacks for subsequent removal by an operator. Each the sheet-copy documents finishing devices, except the last sheet-copy documents finishing device, including a movable unload-while-running safety shield assembly for protecting hands of the operator from the moving parts during an unload-while-running operation of the copy sheet documents producing machine.

While the invention has been described with reference to the structure herein disclosed, it is not confined to the details as set forth and is intended to cover any modification and changes that may come within the scope of the following claims.

What is claimed is:

1. A sheet-copy documents producing machine comprising:

(a) sheet supply and feeding means for supplying and feeding image receiving sheets along a path and through image forming stations;

(b) image forming means mounted at said image forming stations for forming desired images on said image receiving sheet resulting in sheet-copy documents of said desired images; and (c) plural sheet-copy documents finishing devices including (i) moving parts, and (ii) at least a first sheet-copy documents finishing device and a last sheet-copy documents finishing device for each receiving, finishing and stacking said sheet-copy documents into stacks for subsequent removal by an operator, each said sheet-copy documents finishing device, except said last sheet-copy documents finishing device, including a movable unload-while-running safety shield assembly for protecting hands of the operator from said moving parts during an unload-while-running operation of the sheet-copy documents producing machine.

2. The sheet-copy documents producing machine of claim 1, wherein said moving parts include sheet transport nip rollers and movable sheet directing and limiting devices.

3. The sheet-copy documents producing machine of claim 1, wherein said moving parts include a sheet registration, and compiling and release assembly.

4. The sheet-copy documents producing machine of claim 1, wherein said moving parts include a sheet set stacker and elevator assembly.

5. The sheet-copy documents producing machine of claim 1, wherein said safety shield assembly comprises:

(a) a frame defining a sheet set stacking housing;

(b) a position detector for detecting a lower limit position of a movable sheet set stacking elevator tray mounted within said sheet set stacking housing;

(c) a front access door subassembly for allowing and inhibiting operator access into said sheet set stacking housing; and (d) a safety shield device for protecting hands of the operator from said moving parts during an unload-while-running operation of the copy sheet documents producing machine, said safety shield device including (i) a shielding member having a parked position and a protective position relative to said sheet set stacking housing, and (ii) moving means for moving said shielding member from one to the other of said parked position and said protective position.

6. The sheet-copy documents producing machine of claim 4, wherein said sheet set stacker and elevator assembly includes an up and down movable sheet stacking elevator tray having an upper limit position and a lower limit position.

7. The sheet-copy documents producing machine of claim 5, wherein said position detectors include a sensor, and a sensor flag mounted on said frame of said sheet set stacker housing, for detecting said lower limit position of said movable sheet set stacking elevator tray.

8. The sheet-copy documents producing machine of claim 5, wherein said front access door subassembly includes a shutter and an automatic shutter lock, said shutter lock being unlockable responsively to said position detector detecting said lower limit position of said movable sheet set stacking elevator tray.

9. The sheet-copy documents producing machine of claim 5, wherein said front access door subassembly a selectively actuatable unload switch for activating an unload condition of said safety shield assembly.

10. The sheet-copy documents producing machine of claim 5, wherein said shielding member comprises a flexible one piece panel.

11. The sheet-copy documents producing machine of claim 5, wherein said shielding member comprises a flexible one piece panel clamped to embossed cross slats.

12. The sheet-copy documents producing machine of claim 5, wherein said shielding member comprises a flexible one piece stainless steel panel clamped to embossed cross slats.

13. The sheet-copy documents producing machine of claim 5, wherein said moving means include a track member for entraining ends of said shielding member.

14. The sheet-copy documents producing machine of claim 5, wherein said moving means include a drive assembly include an electric motor and a timing belt.

15. The sheet-copy documents producing machine of claim 5, wherein said front access door is controlled to open only when said shielding member is in said protective position.

16. The sheet-copy documents producing machine of claim 5, wherein said parked position of said shielding member is vertical and to one side of said access door and said protective position is horizontal above said movable sheet stacking elevator tray.

17. The sheet-copy documents producing machine of claim 6, wherein said sheet set stacker and elevator assembly includes a sensor mounted on said up and down movable elevator tray, and a sensor flag for detecting said upper limit position.

18. The sheet-copy documents producing machine of claim 6, wherein said sheet set stacker and elevator assembly includes a sheet set stacking housing having a frame enclosing said movable sheet stacking elevator tray.

19. The sheet-copy documents producing machine of claim 8, wherein said automatic shutter lock comprises a solenoid device.

20. The sheet-copy documents producing machine of claim 9, wherein actuating said actuatable unload switch causes said movable sheet set stacking elevator tray to move to said lower limit position and said shielding member to move into said protective position.

* * * * *